US006022013A

United States Patent [19]

Foglino et al.

[11] Patent Number: 6,022,013

[45] Date of Patent: Feb. 8, 2000

[54] DEVICE FOR SELECTIVELY FEEDING SHEETS FROM TWO TRAYS IN AN OFFICE MACHINE

[75] Inventors: Roberto Foglino, Montaldo Dora; Mario Manzone, Mazze' ; Daniele Mazzini, Caluso, all of Italy

[73] Assignee: Olivetti Lexikon S.p.A., Ivrea, Italy

[21] Appl. No.: 09/005,636

[22] Filed: Jan. 12, 1998

[30] Foreign Application Priority Data

Jan. 13, 1997 [IT] Italy ..... T001897A

[51] Int. Cl.[7] ..... B65H 3/44; B65H 5/26

[52] U.S. Cl. ..... 271/9.08; 271/9.11; 271/9.13

[58] Field of Search ..... 271/9.02, 9.04, 271/9.07, 9.08, 9.11, 9.13

[56] References Cited

U.S. PATENT DOCUMENTS

| | | | |
|---|---|---|---|
| 3,756,586 | 9/1973 | Craft | 217/9 |
| 4,053,152 | 10/1977 | Matsumoto | 271/9 |
| 5,116,034 | 5/1992 | Trask et al. | 271/2 X |
| 5,527,026 | 6/1996 | Padget et al. | 271/22 |
| 5,575,467 | 11/1996 | Williams | 271/122 |

FOREIGN PATENT DOCUMENTS

| | | | |
|---|---|---|---|
| 355123833 | 9/1980 | Japan | 271/9.07 |
| 404055231 | 2/1992 | Japan | 271/9.11 |
| 2022059 | 12/1979 | United Kingdom . | |

*Primary Examiner*—William E. Terrell
*Assistant Examiner*—K W Bower
*Attorney, Agent, or Firm*—Banner & Witcoff, Ltd.

[57] ABSTRACT

A device (21) for selectively feeding sheets (24, 28) contained in two separate trays (22, 26) by means of a pick-up unit (31), wherein the latter is located between the two trays (22,26). The latter-named (22, 26) are fulcrum-mounted on a structure (33) and are driven alternatively by a motor (61) depending on the latter's direction of rotation so as to be brought selectively into sliding engagement with the pick-up unit (31), and accordingly result in one sheet at a time being picked up and fed from one or the other of the two trays (22, 26). The device (21) is particularly suitable for incorporation in an office machine, such as for example a facsimile system (20) or a printer, for selectively feeding sheets of different types.

13 Claims, 7 Drawing Sheets

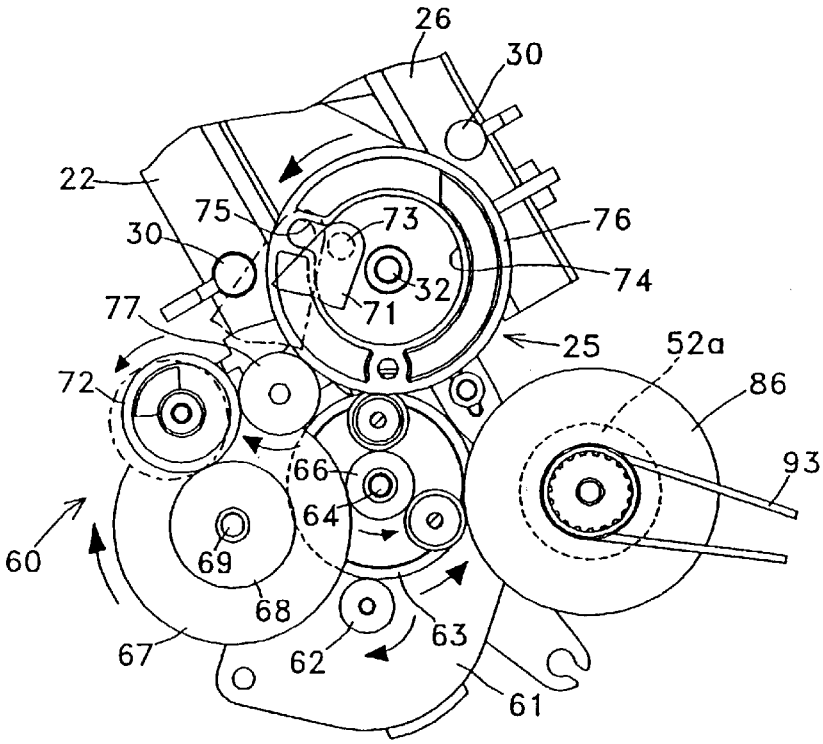
Fig. 6
Fig. 7
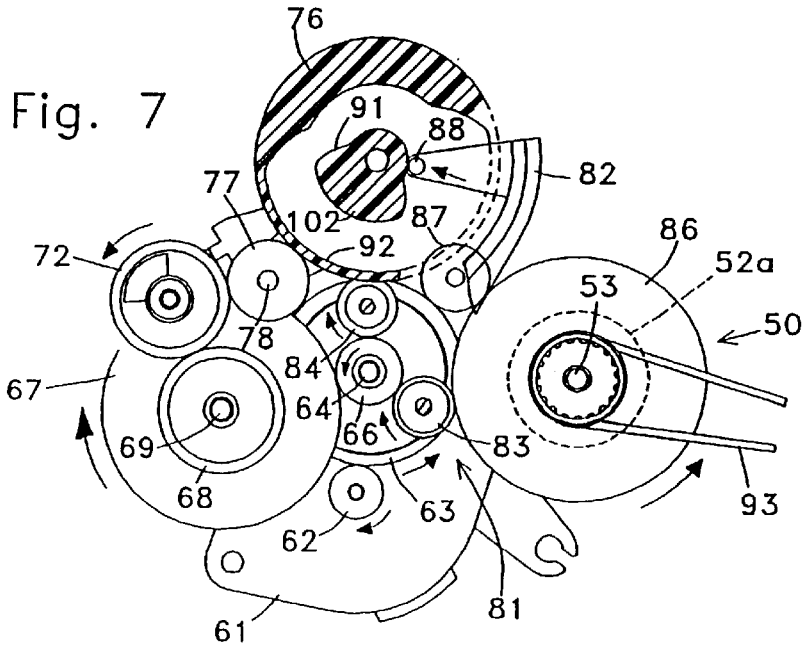

Fig. 9
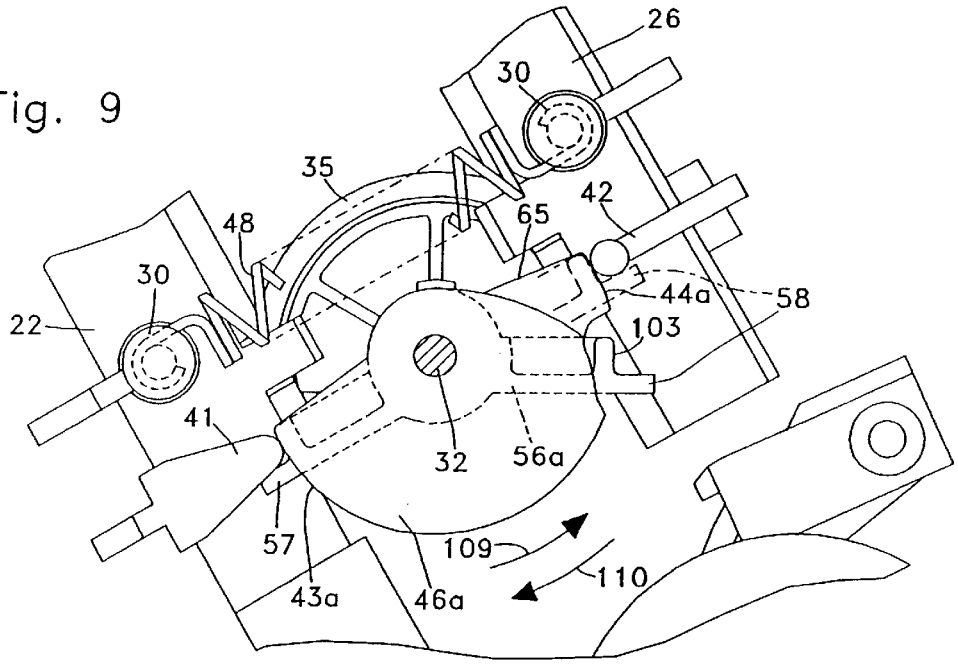
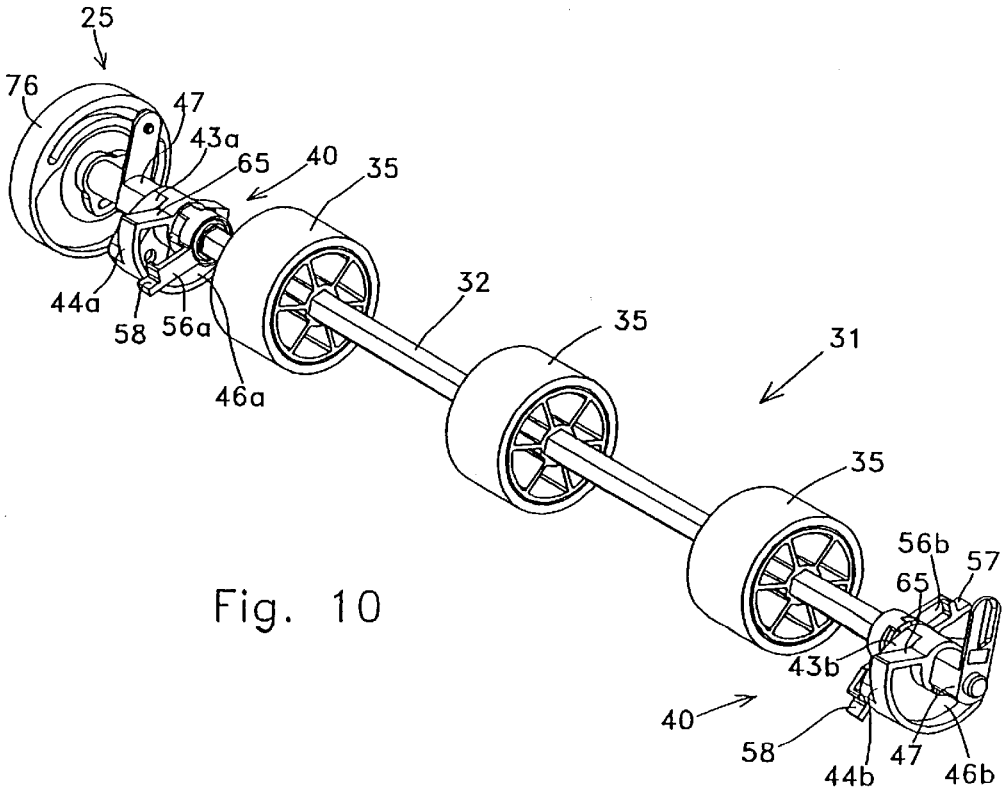
Fig. 10

DEVICE FOR SELECTIVELY FEEDING SHEETS FROM TWO TRAYS IN AN OFFICE MACHINE

FIELD OF THE INVENTION

The present invention relates to a device for feeding sheets in an office machine, such as for example a facsimile system, a printer, a photocopier or any other office machine requiring sheets to be fed from separate trays.

More specifically, the device is of the type comprising a first tray for supporting thereon a first stack of sheets, a second tray for supporting thereon a second stack of sheets, and separating means for selectively engaging with one stack or the other and picking up and feeding a single sheet at a time.

BACKGROUND OF THE INVENTION

Devices for feeding sheets having the characteristics outlined above are widely known and used in the sector art, and are employed especially on facsimile type office machines for feeding one at a time both recording sheets destined to be printed by a printing unit, and original copies destined to be read by a read unit of the facsimile system.

In these known devices the separating means are typically comprised of one or more rotating rollers, arranged adjacent to one face of the stacks and suitable for engaging with the sheet laid on the said face to pick it up off the other sheets of the stack.

One of these known devices is described in U.S. Pat. No. 4,025,066 and comprises a first tray fulcrum-mounted on a fixed structure and adapted to support a first stack of sheets, a second tray slidingly fitted on the first tray and adapted to support a second stack of sheets, and a feed roller suitable for engaging selectively with one or the other of the stacks for separating and feeding sheets from the stacks.

The second tray is adapted to selectively slide along the first tray between a forward position, wherein it completely covers the first tray and brings the second stack into engagement with the roller, and a withdrawn position, wherein it partially uncovers the first tray to grant the first stack access to the roller for a sheet to be picked up.

This device adopts highly complex mechanical solutions, requiring a particularly high number of parts to move the two trays and selectively bring the relative stacks into engagement with the feed roller. Accordingly this device may be quite expensive to manufacture as well as to maintain.

SUMMARY OF THE INVENTION

The technical problem that the present invention intends to solve is that of constructing a device capable of picking up and feeding sheets from two stacks of sheets accommodated in two corresponding trays, and which is generally better than similar known devices, being in particular easier to build and less expensive than the latter-named.

This problem is solved by a feeding device according to the present invention, wherein the sheet separating means are located between the first and the second tray and are adapted to rotate according to a first direction of rotation to pick up and feed one sheet at a time from the first stack, and according to a second direction of rotation to pick up and feed one sheet at a time from the second stack.

The present invention also refers to a generic office machine incorporating a device for feeding sheets from two trays having the characteristics outlined above.

BRIEF DESCRIPTION OF THE DRAWINGS

This and other characteristics of the invention will become apparent upon consideration of the following description, provided by way of a non-exhaustive example, in conjunction with the accompanying drawings, where:

FIGS. 6 and 7 are enlarged scale, partial views illustrating disposition of some details of FIG. 5, at the beginning of a sheet feed cycle from a first tray or from a second tray of the device of the invention;

FIG. 9 is another lateral view illustrating in detail and enlarged scale a zone of the device of FIG. 2 indicated by the arrow IX; and FIG. 10 is a perspective view of a pick-up unit of the device of FIG. 1.

DESCRIPTION OF A PREFERRED EMBODIMENT OF THE INVENTION

Figure 1:
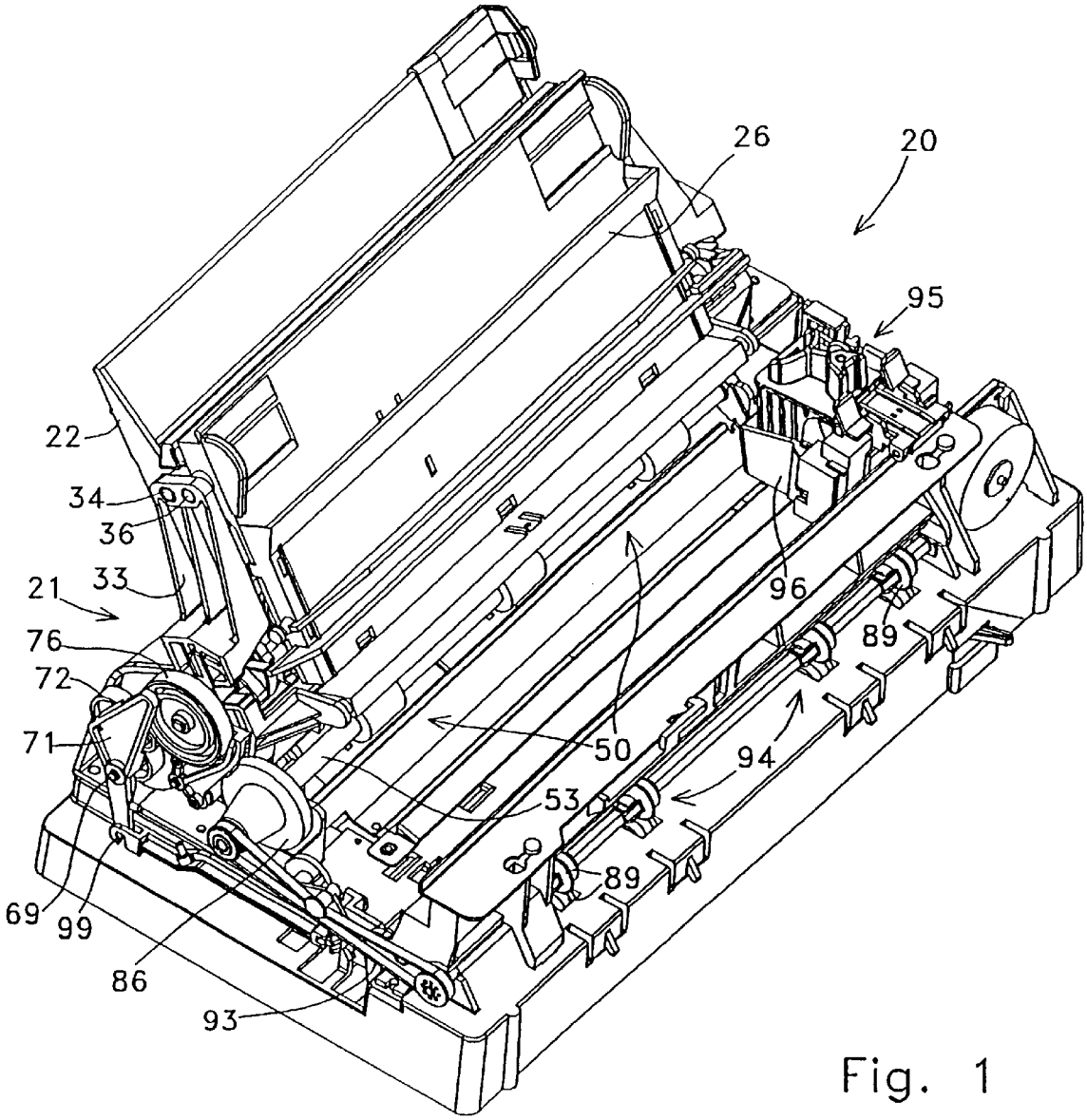
FIG. 1 is a perspective view of an office machine incorporating a device for feeding sheets according to the present invention.

With reference to FIG. 1, a device according to the invention for feeding sheets, generally designated 21, is shown incorporated in an office machine 20, a facsimile system for example.

Figure 2:
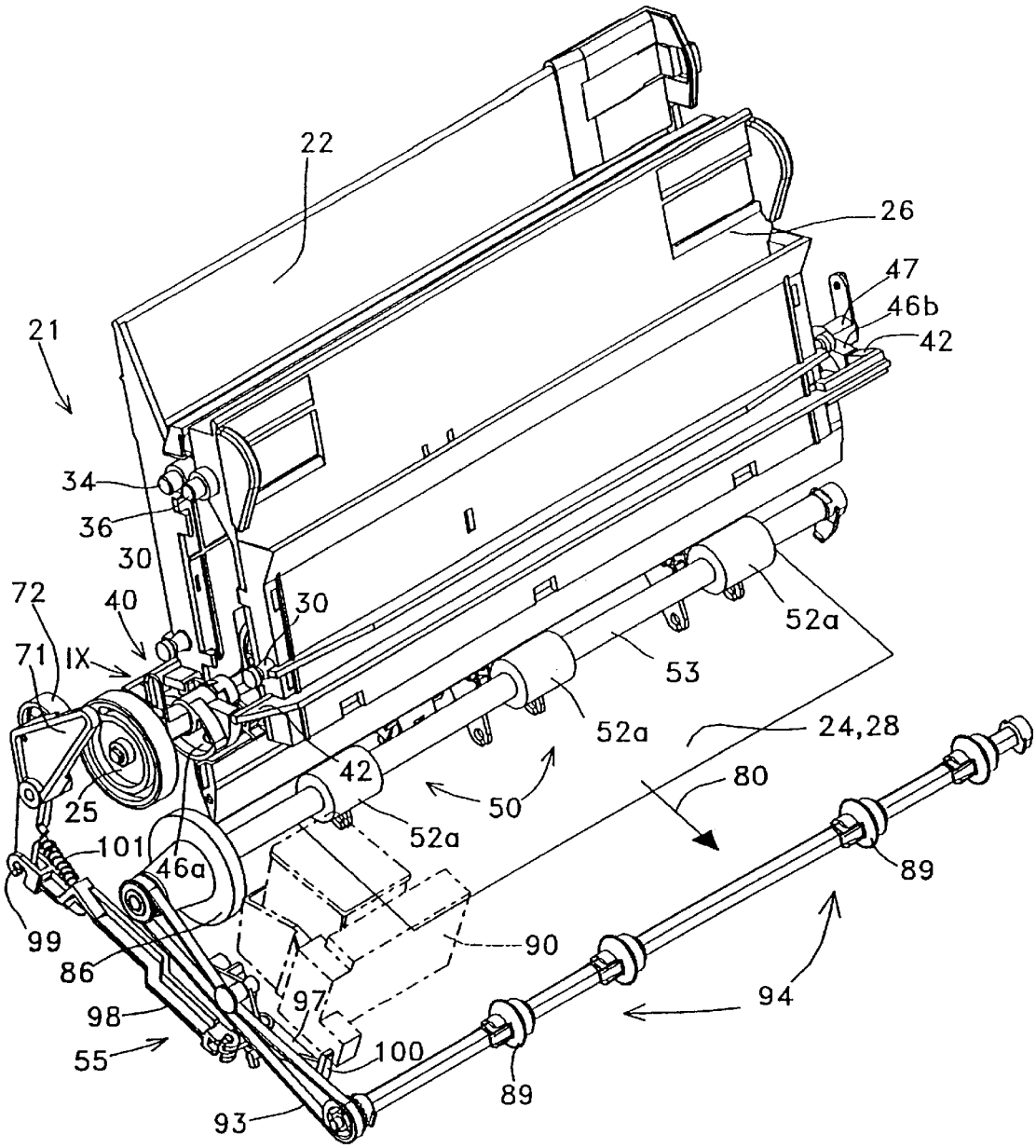
FIG. 2 is a partial perspective view better illustrating the device of FIG. 1.

Furthermore, for clarity's sake, in FIG. 2 the device 21 is shown partially removed from the facsimile system 20.

The device 21 comprises a first tray 22 accommodating a first stack 23 of recording sheets 24 whereon to reproduce a document when the facsimile 20 is receiving, and a second tray 26 accommodating a second stack 27 of original sheets 28, namely the documents that must be read by a read unit of the facsimile 20, when transmitting.

Dimensions of the sheets comprising the stacks 23 and 27, which may even comprise one sheet alone, are abundantly variable.

Figure 3:
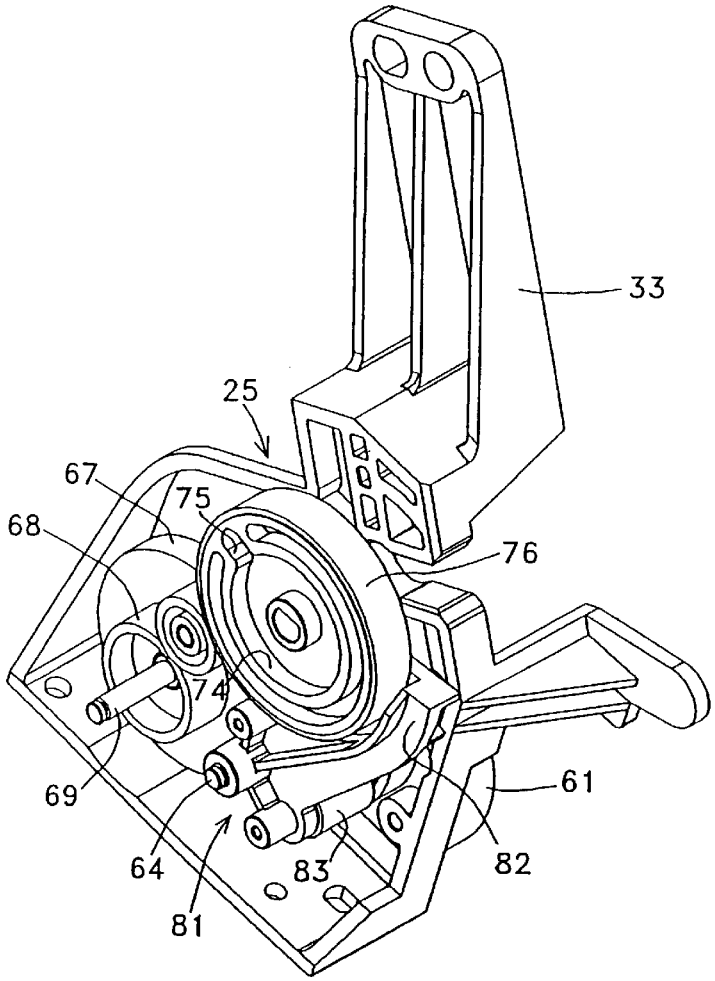
FIG. 3 is an enlarged scale, perspective view from the outside of a lateral zone of the device of FIG. 1.
Figure 4:
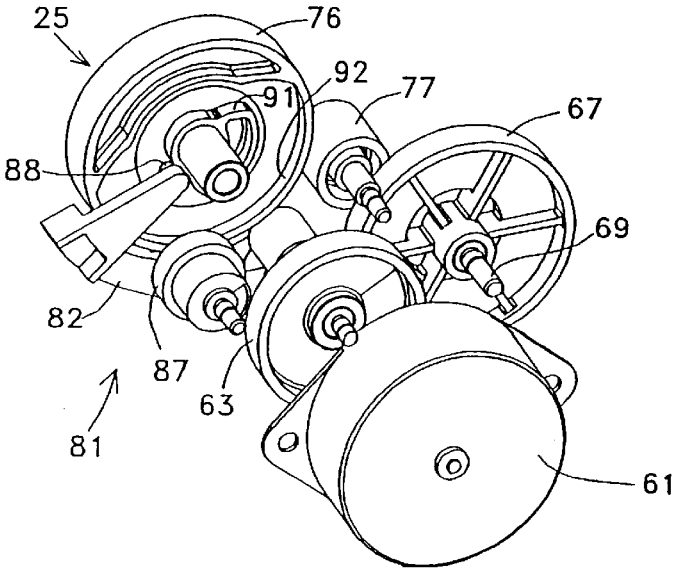
FIG. 4 is a perspective view from the inside of the zone of FIG. 3.

The device 21 also comprises: separating means 31 (FIG. 8) for picking up and feeding the sheets 24 and 28 from the respective stacks 23 and 27; a selection mechanism 40 (FIGS. 2 and 10) for selectively bringing the trays 22 and 26 closer to the separating means 31, so as to bring one or the other of the stacks 23 and 27 into engagement with the latter-named; an actuating and control member 25 (FIG. 2) suitable for rotating to actuate both the separating means 31 and the selection mechanism 40; a motor 61 (FIG. 6) provided for motorizing the device 21 and suitable for rotating in two directions of rotation, respectively clockwise to produce feeding of a recording sheet 24 from the tray 22 and counter-clockwise to produce feeding of an original sheet from the tray 26; a lever mechanism 55 (FIG. 2) for enabling or otherwise the actuating member 25 to rotate and selectively receive motion from the motor 61; and a mono-directional command group 81 (FIG. 3) adapted to be controlled by the member 25 and transmit the motion from the motor 61 to a feeding group 50 (FIG. 8) arranged downstream of the trays 22 and 26, so as to feed the sheets 24 and 28 through the facsimile system 20 according to a single direction 80 (FIG. 2). irrespective of the direction of rotation of the motor 61.

In greater detail, the separating means 31 consist of a rotating pick-up unit, located between the trays 22 and 26, and having three separating rollers 35 (FIG. 10) attached to a shaft 32, in turn rotatingly mounted on a fixed structure 33 of the device 21. Normally the fixed structure 33 is integrated with a bearing frame of the facsimile system 20 incorporating the device 21.

Each of the trays 22 and 26 is provided with an upper aperture through which it may be filled with the relative stack 23 and 27 and has a substantially parallelepiped shape defined by two parallel walls a distance apart in the direction of the thickness of the stack, two side walls, and a back wall 37 and 38 (FIG. 8) respectively, provided to act as an abutment to the corresponding stack 23 and 27, aligning it with a front edge thereof.

A first pair of pins 34 and a second pair of pins 36 (one only of the pins of each pair is shown in the drawings) are affixed, one per side, to an upper portion of the side walls of the tray 22 and of the tray 26 respectively and are pivotal about the structure 33, to allow the trays to rotate.

Figure 8:
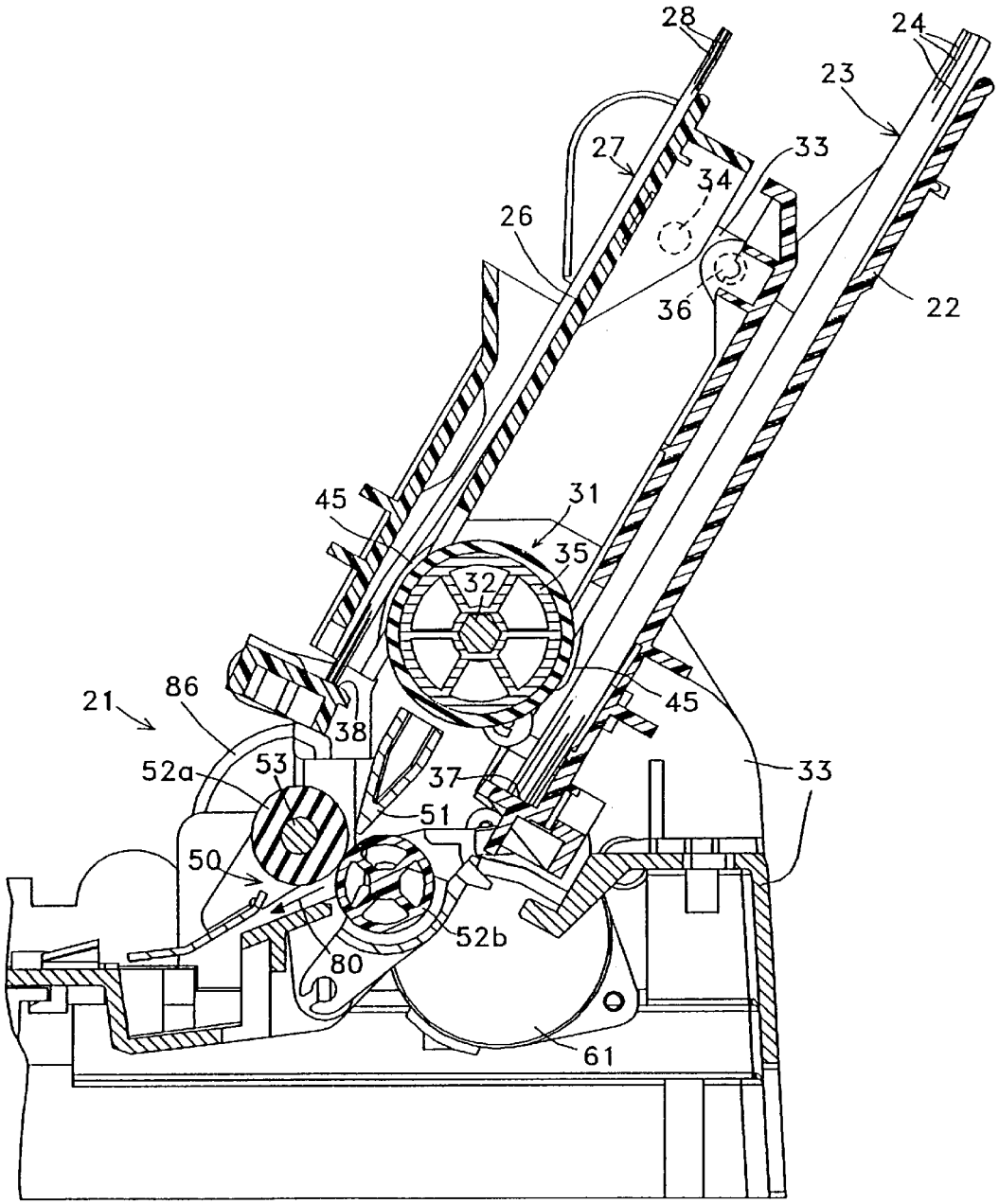
FIG. 8 is a partial central section of the device of FIG. 1.

The trays 22 and 26 may, by means of the selection mechanism 40, selectively assume an idle position and a work position. In the idle position, both the trays 22 and 26 are a certain distance away from the separating means 31, as depicted in FIG. 8, whereas the stacks 23 and 27 are kept removed from the separating rollers 35 by projecting bands 45 made in the sides of the trays 22 and 26.

In the work position, the first tray 22 or the second tray 26 is selectively brought against the separating means 31, so that the separating rollers 35 engage with one or other of the stacks 23 and 27.

The selection mechanism 40 (FIG. 10) comprises two radial cams 46*a* and 46*b* affixed on the shaft 32 and arranged between two bosses 47, rotatingly supporting the shaft 32 on the fixed structure 33, and the outermost separating rollers 35 of the separating means 31.

The two cams 46*a* and 46*b* each comprise two tracks 43*a*, 44*a* and 43*b*, 44*b* respectively, disposed one beside the other in each cam.

The two tracks 43*a* and 43*b* of the cams 46*a* and 46*b* respectively are adapted to command a corresponding pair of projections 41 (one only of which illustrated in FIG. 9) integral with the tray 22 and arranged to the sides of the latter under the pins 34, so as to selectively rotate the tray 22 about the pins 34.

Similarly the two tracks 44*a* and 44*b* of the cams 46*a* and 46*b* are adapted to command a corresponding pair of projections 42 (FIGS. 2 and 9) integral with the tray 26 and arranged to the sides of the latter, so as to selectively rotate the tray 26 about the pins 36.

The two pairs of projections 41 and 42 are arranged at opposite ends of the cams 46*a* and 46*b* and are subject to a thrust force, exerted by two springs 48 (one only of which illustrated in FIG. 9), tending to urge them constantly against the respective tracks 43*a*, 43*b* and 44*a*, 44*b*. In particular, the ends of each spring 48 are hooked to two pins 30 integral with the tray 22 and the tray 26 respectively and made in the sides thereof.

The selection mechanism 40 also comprises two balancer arms 56*a* and 56*b* (FIG. 10) arranged sideways to the cams 46*a* and 46*b* respectively, rotatingly mounted on the shaft 32, having the purpose of selectively keeping in the idle position, away from the separating means 31, whichever tray 22 or 26 is not selectively brought against the separating means 31 for feeding of a sheet, during operation of the device 21 as described hereinbelow.

Engagement between the balancer arms 56*a* and 56*b* and the shaft 32 is made rotating so that a friction is created that tends to cause rotation of the balancer arms 56*a* and 56*b* together with the shaft 32.

Made in each of the ends of the balancer arms 56*a* and 56*b* are two seats 57 and 58 on opposite sides with respect to the shaft 32 and having the purpose of co-operating with the projections 41 and 42 respectively (FIG. 9).

A transport guide 51 (FIG. 8), integral with the fixed structure 33 and disposed slightly below the separating means 31, is designed to transport along two separate paths the recording sheets 24 and the original sheets 28 coming from the respective trays 22 and 26, so that they are directed towards a feeding group generally designated 50 and consisting of three pairs of feeding rollers 52*a* and 52*b*.

The feeding rollers 52*a* and 52*b* of each pair are pressed one against the other in a known way in order to grip the sheets arriving from the trays 22 and 26, and are also adapted to rotate and feed the gripped sheets in the direction indicated by the arrow 80.

A shaft 53 bears the feeding rollers 52*a* disposed at the top of each pair and is adapted to set in rotation, by means of the upper rollers 52*a*, the feeding rollers 52*b* disposed at the bottom of each pair. The latter are rotatingly supported in a known way and, for example, may be mounted directly on the structure 33, each one independent from the other.

The motor 61 (FIG. 6) is provided with a pinion 62 connected with a linkage, generally designated 60, through which the motor 61 selectively commands, by rotating the pinion 62 in one direction or the other, feeding of the recording sheets 24 or of the original sheets 28 from the respective trays 22 and 26.

For clarity of illustration, the pinion 62 and all the various gears introduced in the following are schematically illustrated in the drawings without teeth.

The linkage 60 comprises a first gear 63 meshing with the pinion 62 and rotating about a pin 64 attached to the fixed structure 33. The first gear 63 is integral with a second gear 66, of lesser diameter, which in turn meshes with a third gear 67 integral with a fourth gear 68. The gears 67 and 68 are made rotating about a pin 69 attached to the fixed structure 33 and upon which a command lever 71 (FIGS. 2 and 6) is in turn fulcrum-mounted. The latter, as will be seen in greater detail below, is part of the already cited lever mechanism 55 and has the function, by rotating about the pin 69, of selectively enabling the actuating member 25 to rotate and selectively receive motion from the motor 61.

A fifth idle gear 72 (FIGS. 2 and 6) is rotatingly mounted on the command lever 71 at a suitable distance from the pin 69 so as to be in constant meshing engagement with the fourth gear 68, during rotation of the command lever 71 about the pin 69.

The command lever 71 has an upper arm provided at one end with a follower pin 73 suitable for following a profile 74 made on an outer face of the actuating and control member 25.

Figure 5:
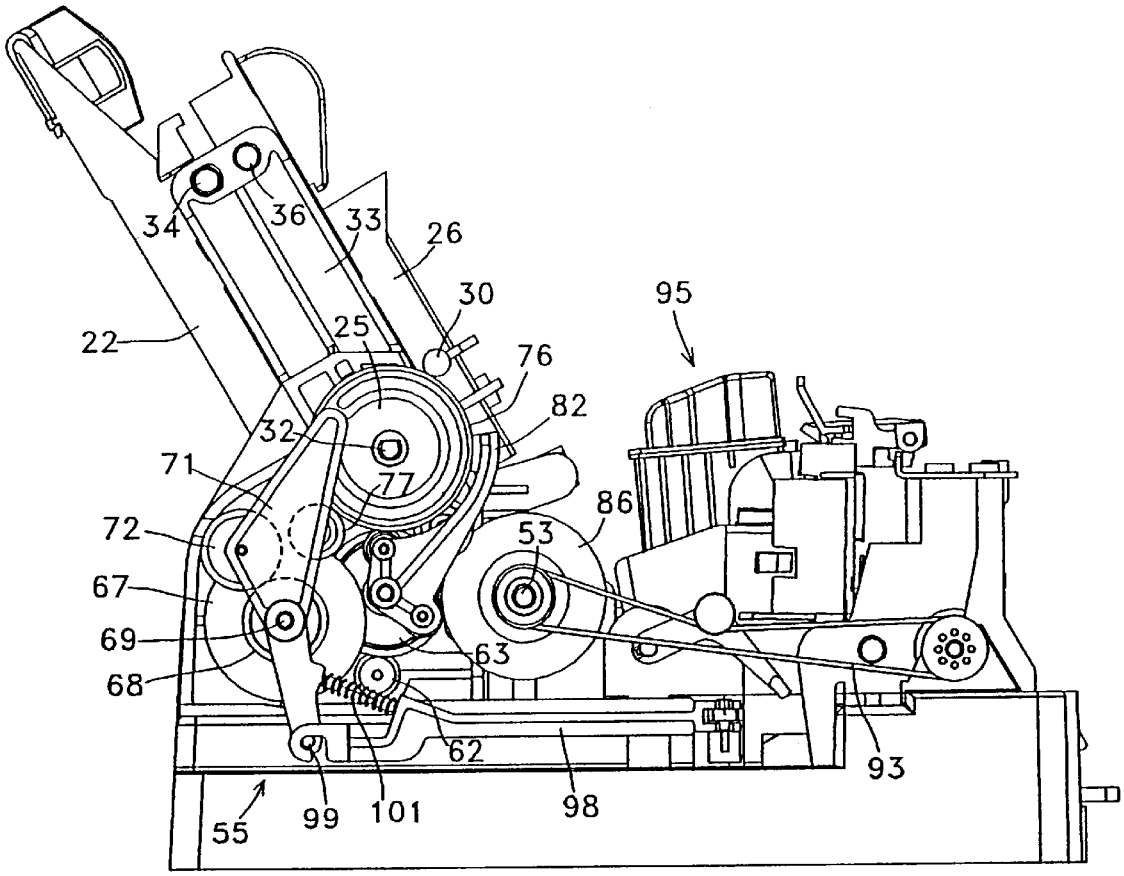
FIG. 5 is a lateral view of the device of FIG. 1.

The gear 72 is adapted to selectively mesh with an intermediate gear 77, rotating about a pin 78 affixed to the structure 33, following a rotation (FIGS. 5 and 6) of the lever 71 about the pin 69. The intermediate gear 77 is in constant meshing engagement with a crown gear 76 provided on the periphery of the actuating member 25.

It will be apparent, therefore, that the command lever 71, by rotating clockwise or counter-clockwise about the pin 69 to engage or disengage respectively the gears 72 and 77, is suitable for selectively enabling or otherwise the transmission of motion from the motor 61 to the actuating member 25.

The actuating member is integrally mounted on one end of the shaft 32 (FIG. 10), and is therefore integral with the separating means 31.

The profile 74 defines a recess 75 (FIG. 6) with which the pin 73 is adapted to engage after the actuating member 25 and therefore also the separating means 31 have performed a rotation of one turn in order to feed the sheets 24 and 28 from the respective trays, and from which the pin 73 is adapted to disengage to permit this rotation.

More particularly, with reference to FIG. 6, the actuating member 25 is envisioned to rotate counter-clockwise in order to pick up and feed the recording sheets 24 from the first stack 23 accommodated in the first tray 22 and clockwise in order to pick up and feed the original sheets 28 of the second stack 27 accommodated in the second tray 26.

On a face opposite that wherein the profile 74 is made, the actuating member 25 is provided with a cam having two profiles, respectively an inner profile 91 (FIG. 7) and an outer profile 92, adapted to control the rotation about the pin 64 of the monodirectional command group 81.

The latter-named is located between the motor 61 and the feeding group 50 and comprises an arm 82 arranged beside the gear 66 and rotatably mounted on the pin 64, and a pair of gears comprised by a first movable gear 83 and a second movable gear 84 pivotally supported by the arm 82 and arranged at opposite ends with respect to the pin 64.

Further, the arm 82 is linked with the gear 66 so as to exchange with the latter a frictional force tending to set the arm 82 in rotation about the pin 64, and hence to move the movable gear 83 and 84, consistently with the direction of rotation of the gear 66.

More specifically, as can be seen clearly in FIG. 7, a clockwise rotation of the motor 61 determines a corresponding counter-clockwise rotation of the arm 82 about the pin 64, accordingly causing the first movable gear 83 to mesh with a feeder gear 86 affixed to the shaft 53 and therefore integral with the upper rollers 52*a* of the feeding group 50.

Conversely, a counter-clockwise rotation of the motor 61 determines a corresponding clockwise rotation of the arm 82, accordingly causing the second movable gear 84 to mesh with an intermediate gear 87, in turn constantly meshing with the feeder gear 86.

Consequently the monodirectional command group 81 is suitable for commanding the feeder gear 86 and thus maintain constant the direction of rotation thereof, even in the event of an inversion in the direction of rotation of the motor 61.

It will thus be clear that the function of the monodirectional command group 81 is that of commanding the feeding group 50 by way of the motor 61, so that feeding of the sheets 24 and 28 through the facsimile system 20 is performed, whatever the direction of rotation of the motor 61, according to a single direction, indicated by the arrow 80, intended to extract and move the sheets 24 and 28 away from the respective trays 22 and 26.

A pin 88 is affixed to one end of the arm 82 and is suitable for being guided by the profiles 91 and 92 to control the rotation of the arm 82 about the pin 64, so that the movable gears 83 and 84 mesh with the feeder gear 86 and with the intermediate gear 87 respectively only upon completion of a predetermined angular displacement of the actuating member 25. Accordingly, the profiles 91 and 92 are suitable for determining precisely, in the context of the cycles described later for feeding of the sheets from the respective trays, the time at which the pairs of feeding rollers 52*a*, 52*b* start to rotate in order to feed the sheets 24 and 28.

The feeding group 50 is adapted to command, by means of a belt 93, the rotation of a further feeding group 94 (FIG. 2), similar to the group 50, and suitable for receiving from the latter the sheets 24 and 28 in order to feed them further.

The further feeding group 94 comprises an arrangement of pairs of wheels 89 (FIGS. 1 and 2), suitable for gripping the sheets 24 and 28 and for co-operating with the group 50 to determine precise feeding of the sheets through the facsimile system 20.

More specifically, the feeding group 94 may be disposed, in the sheet feeding direction indicated by the arrow 80, after a printing unit 95 (FIG. 1) and a read unit (not shown in the drawings), accommodated in the facsimile system 20 and suitable respectively for printing the sheets 24 and reading the sheets 28.

The lever mechanism 55 (FIG. 2) comprises, in addition to the command lever 71, a lever 97 fulcrum-mounted on one side of the bearing frame of the facsimile system 20, and a bar 98 joined at one end with the lever 97 and at the other end with the command lever 71 by a joint 99. In particular the lever 97 has one end 100 protruding towards the inside of the facsimile system 20 and adapted to co-operate with a movable carriage 96 (FIG. 1) of the printing unit 95, suitable for moving transversally with respect to the feeding direction 80 of the sheets.

Furthermore, a compression spring 101 (FIGS. 2 and 5) is fitted between the bar 98 and the command lever 71, for applying thereto a force tending to remove the one from the other by making them rotate about the joint 99.

The carriage 96 is provided for actuating the end 100 of the lever 97 so as to command, through the lever mechanism 55, a clockwise rotation (FIG. 5) of the lever 71 when, during its transversal stroke, it enters the predetermined position 90 indicated with the dot and dash line in FIG. 2, adjacent to the side of the facsimile system 20 whereon the lever 97 is fulcrum-mounted.

Description of Operation of the Invention

Operation of the device will now be described in detail, where the description is divided into two parts corresponding to the two cycles into which the said operation may be divided, namely a first recording sheet feeding cycle for feeding recording sheets from the first tray and a second original sheet feeding cycle for feeding original sheets from the second tray.

Recording Sheet Feeding Cycle

The recording sheet feeding cycle, often referred to as ASF—the abbreviation of Automatic Sheet Feeding, corresponds to rotation by one turn of the actuating member 25 and starts from an idle condition wherein the pin 73 of the command lever 71 is engaged with the recess 75, as indicated by the dash and dot line in FIG. 6. In this idle condition, the separating means 31 are stationary and disconnected from the motor 61, the gears 72 and 77 not being in meshing engagement with each other. Further the cams 46*a* and 46*b* are in the position illustrated in FIG. 9 wherein the corresponding pairs of tracks 43*a*, 43*b* and 44*a* and 44*b* respectively mesh with the projections 41 and 42 to maintain the trays 22 and 26 at a remove from the separating means 31.

At this point the print carriage 96, which may be located at any point along its transversal stroke, goes to the lateral position 90 (FIG. 2) and consequently presses against the end 100 of the lever 97, causing it to rotate.

Rotation of the lever 97 causes the horizontal displacement leftwards (FIG. 5) of the bar 98 and accordingly the clockwise rotation of the command lever 71 about the pin 69 to disengage the pin 73 from the recess 75, as indicated by the unbroken line in FIG. 6.

Further, the clockwise rotation of the command lever 71 results in the gear 72 meshing with the gear 77, so that the actuating member 25 is cinematically linked with the motor 61.

It is clear that disengagement of the pin 73 from the recess 75 may be produced using different methods and means from those described above, without exiting from the scope of the invention.

For example, instead of using the print carriage 96 and a lever mechanism commanded thereby, a common electromagnet may be used or any other actuator of known type associated with the command lever 71 for determining a rotation thereof designed to disengage the pin 73 from the recess 75.

After this disengagement, the motor 61 starts to rotate clockwise as indicated in FIG. 6 producing, as may be verified simply by following the transmission of motion along the linkage 60 of gears connecting the pinion 62 with the actuating member 25, a counter-clockwise rotation of the latter.

The counter-clockwise rotation of the actuating member 25 continues until when the recess 75 is again disposed in correspondence with the pin 73, which occurs after one complete turn is performed and therefore at the end of the ASF cycle.

At this point in fact, the action of the spring 101 (FIG. 6) urges the command lever 71 to rotate counter-clockwise about the pin 69, so that the pin 73 again engages with the recess 75 and blocks the actuating member 25, preventing it from continuing to rotate. Simultaneously the gears 72 and 77 disengage, thereby breaking the linking connection between the motor 61 and the actuating member 25. In the meantime the motor 61 is commanded to cease its clockwise rotation.

The counter-clockwise rotation of the command lever 71 to again engage the pin 73 with the recess 75 is made possible by the fact that the carriage 96 has moved away from the lateral position 90, detaching itself from the lever 97, well before the rotation of one turn by the actuating member 25 has been completed.

Accordingly therefore, when the recess 75 is disposed in front of the pin 73, the command lever 71 and the bar 98 are no longer compelled and may therefore rotate about the joint 99 to move away from each other as urged by the compression spring 101, consequently producing the counter-clockwise rotation of the command lever 71.

During the rotation of one turn by the actuating member 25 the cams 46*a* and 46*b* also rotate counter-clockwise (FIG. 9) according to the arrow 109 and, by co-operating with the projections 41, cause the rotation of the first tray 22 about the pins 34 to move it closer to the separating means 31 urged therein by the springs 48, until a first recording sheet 24 of the stack 23 is engaged by the separating rollers 35 rotating integrally with the member 25.

In a first step of the rotation by one turn of the actuating member 25, the shaft 32 drives the balancer arms 56*a* and 56*b* in counter-clockwise rotation until the seats 58 thereof are resting laterally against the projections 42 of the second tray 26, as indicated by the dot and dash line in FIG. 9.

At this point, the balancer arms 56*a* and 56*b* stop, whereas the shaft 32 continues rotating counter-clockwise. This rotation causes the tracks 44*a* and 44*b* to present portions thereof 65 (FIG. 10) slanting towards the shaft 32 to the projections 42, so that the latter-named are retained by the seats 58 of the balancer arms 56*a* and 56*b* and the projections 42 are prevented from further following the tracks 44*a* and 44*b*.

In fact, when the portions 65 are exactly facing the projections 42, the latter are urged by the springs 48 against steps 103 (FIG. 9) made in the seats 58, applying thereto instead of to the tracks 44*a* and 44*b* the thrust of the springs 48 on the tray 26.

The object of retaining the projections 42 and therefore the tray 26 is that of avoiding the latter from drawing close to the separating means 31 and bringing the relative stack 27 into meshing engagement with the separating means 31, which is already rotating in engagement with the stack 23, accordingly producing ejection of the original sheets 28 from the tray 26.

The projections 42 continue to rest against the steps 103, under the thrust force of the springs 48, until the tracks 44*a* and 44*b* again engage with the projections 42, towards the end of the counter-clockwise rotation by one turn of the actuating member 25, to detach them slightly from the steps 103.

Thus during the counter-clockwise rotation of one turn made by the actuating member 25 to complete the ASF cycle, the tray 26 remains constantly removed from the separating means 31 and does not interfere in the slightest with performance of this cycle.

To return to the first recording sheet 24, under the thrust and rotation of the separating rollers 35, the said sheet is separated from the other sheets of the stack 23 and fed towards the pairs of pairs of rollers 52*a*, 52*b* of the feeding group 50. The separating rollers 35 by rotating feed the first recording sheet 24 until a front edge thereof reaches the pairs of rollers 52*a*, 52*b*, coming to rest against a contact zone of the latter.

In this step the pairs of rollers 52*a*, 52*b* are stationary to permit the recording sheet 24, before being gripped and fed thereby, to rotate about the corners of its front edge under the thrust of the separating rollers 35, in order to eliminate any skew with respect to the said pairs of rollers 52*a*, 52*b* and be disposed perfectly in line therewith.

Then, a certain time after the recording sheet 24 has reached and come to rest on the rollers 52*a* and 52*b*, the latter start rotating for feeding purposes. This delay time is determined by the profile 91 controlling, as it rotates integrally with the actuating member 25 and by means of the pin 88, in turn urged by friction against the said profile 91 by rotation of the gear 66, the rotation of the monodirectional command group 81 about the pin 64.

In particular, the monodirectional command group 81 is controlled by the profile 91 so as to first of all maintain detached the first movable gear 83 and the feeder gear 86 in order to avoid the rotation of the feeding group 50, and then, at the end of a pre-determined rotation of the actuating member 25, so as to draw them closer so that they mesh together, at a time when the front edge of the first recording sheet 24 has already reached the rollers 52*a* and 52*b*.

The first movable gear 83 and the feeder gear 86 are not in meshing engagement during a portion of the rotation by one turn made by the actuating member 25, corresponding to a lobe 102 of the inner profile 91.

Upon meshing of the first movable gear 83 with the feeder gear 86, the first recording sheet 24 is immediately gripped and fed by the pairs of rollers 52*a*, 52*b* towards the printing unit 95 of the facsimile system 20 for printing, after which the first recording sheet continues to be fed until it reaches the further feeding group 94 by means of which it is ejected from the facsimile system 20.

In the meantime, after the first recording sheet has been durably gripped by the feeding rollers 52*a* and 52*b*, the radial cams 46*a* and 46*b*, continuing to rotate counter-clockwise, actuate the projections 41 in order to determine the progressive detachment of the first tray 22 from the separating means 31 and accordingly the disengagement of the latter from the stack 23. After this disengagement, therefore, the feeding of the first recording sheet 24 through the facsimile system 20 continues without being affected by the separating means 31 and is determined exactly and solely by the rotation of the feeding groups 50 and 94, so as to permit proper printing of the first recording sheet 24 by the printing unit 95.

During the final part of the rotation by one turn of the actuating member 25, the first tray 22 is brought back by the cams 46*a* and 46*b* through the projections 41 to the same position of maximum distance from the separating means 31, as it occupied at the beginning of the ASF cycle. At this point, the device 21 is ready to perform another sheet feeding cycle from one or the other of the trays 22 and 26.

More specifically, the first tray 22 remains in this position until when the device 21 starts another recording sheet feeding cycle, by disengaging the pin 73 from the recess 75 and by causing the actuating member 25 to rotate counter-clockwise for one turn through a corresponding clockwise rotation of the motor 61.

Generally speaking the recording sheet feeding cycle described above is repeated in succession for each recording sheet 24 to be printed.

Original Sheet Feeding Cycle

The original sheet feeding cycle, also called ADF—the abbreviation of Automatic Document Feeding, possesses a sequence of steps extremely similar to that of the recording sheet feeding cycle and shall now be described in much less detail than the latter, availing of the earlier description.

In particular the original sheet feeding cycle is activated, rather than by a clockwise rotation as in the case of the recording sheet feeding cycle, by a counter-clockwise rotation of the motor 61 (refer to FIGS. 6 and 7 inverting the direction of the arrows indicated therein) and is intended for separating and feeding a first original sheet 28 from the stack 27 accommodated in the second tray 26.

Again in this case the cycle starts from an idle position wherein the pin 73 is in meshing engagement with the recess 75, the trays 22 and 26 are at a distance from the separating means 31, and the projections 41 and 42 (FIG. 9) are urged by the springs 48 against portions of the tracks 43*a* and 44*a* distant from the shaft 32.

In a first step, a clockwise rotation is activated of the command lever 71 to disengage the recess 75 from the pin 73 and accordingly produce meshing of the gear 72 with the intermediate gear 77, exactly in the same way as already described for the recording sheet feeding cycle.

The motor 61 starts to rotate counter-clockwise producing a corresponding clockwise rotation of the separating means 31 through the linkage 60 that connects pinion 62 to the actuating member 25. As a result, the cams 46*a* and 46*b* also rotate clockwise according to the arrow 110 and, co-operating with the projecting elements 42 by means of the tracks 44*a* and 44*b*, cause the tray 26, urged by the springs 48, to draw closer to the separating means 31 until the stack 27 is in meshing engagement with the separating rollers 35.

In the meantime, similarly to what happens with the projections 42 during the recording sheet feeding cycle, the balancer arms 56*a* and 56*b* are brought into frictional rotation by the shaft 32, so that the seats 57 of the balancer arms 56*a* and 56*b* rest against the projections 41 in preparation to retain the latter, when they are no longer in meshing engagement with the corresponding tracks 43*a* and 43*b*.

The separating rollers 35 produce separation of the first original sheet 28 and feeding towards the feeding group 50.

Because of the clockwise rotation of the motor 61, the monodirectional command group 81 is brought into clockwise rotation about the pin 64 and brings the pin 88 into engagement with the profile 92. The latter controls the rotation of the monodirectional group 81 so that the meshing between the second movable gear 84 and the intermediate gear 87 occurs a certain time after the feeding group 50 is reached by the first original sheet 28, in order to let the latter become perfectly aligned against the pairs of rollers 52*a*, 52*b* and before being gripped and fed thereby.

Meshing between the second movable gear 84 and the intermediate gear 87 causes rotation of the feeding groups 50 and 94, so that the first original sheet 28 is fed towards the read unit of the facsimile system 20 to be read.

The cycle of feeding original sheets from the tray 26 is concluded, upon completion of the clockwise rotation by one turn made by the actuating member 25, with the pin 73 again engaging the recess 75.

It is understood that various changes and/or improvements may be made to the device for feeding sheets from two trays corresponding to the preferred embodiment described in the foregoing, without exiting from the scope of the present invention.

What is claimed is:

1. A device for feeding sheets comprising:

a first tray pivotally mounted on a fixed structure, said first tray supporting a first stack of sheets;

a second tray pivotally mounted on the fixed structure, said second tray supports a second stack of sheets;

separating means rotatably mounted to the fixed structure, said separating means located between said first tray and said second tray for selectively coming into engagement with said first stack or with said second stack of sheets, said separating means selectively rotating in a first direction of rotation, while being engaged with said first stack, to pick up and feed a single sheet at a time from said first stack, said separating means rotating in a second direction of rotation, while being engaged with said second stack, to pick up and feed a single sheet at a time from said second stack; and a selection mechanism provided for selectively rotating said first tray or said second tray toward said separating means, so as to bring said first stack of sheets into engagement with said separating means, when separating means rotates in said first direction of rotation, or to bring said second stack of sheets into engagement with said separating means, when separating means rotates in said second direction of rotation.

2. A device according to claim 1, wherein said first and said second stacks are comprised of at least one sheet.

3. A device according to claim 1, wherein said first tray is brought closer to said separating means during a first feeding cycle to cause the separation of the single sheet from said first stack, and wherein said second tray is brought closer to said separating means during a second feeding cycle to cause the separation of the single sheet from said second stack, said device further comprising an actuating member adapted to rotate in order to simultaneously actuate said separating means and said selection mechanism, and said cycles being produced by making said actuating member rotate by one turn according to said first or to said second direction of rotation.

4. A device according to claim 1, wherein both said first tray and said second tray are extending, in the operative state, along a plane substantially vertical.

5. An office machine incorporating a device for feeding sheets according to claim 1.

6. A device according to claim 1, wherein said selection mechanism is associated with retaining means adapted to keep said second tray with said second stack of sheets selectively removed from said separating means, when the latter are engaged with said first stack of sheets, and keeping said first tray with said first stack of sheets selectively removed from said separating means, when the latter are engaged with said second stack of sheets.

7. A device according to claim 6, wherein said separating means comprise at least one rotating roller on the fixed structure, said selection mechanism comprises a cam integral with said roller and adapted to command the rotation of said trays with respect to said rotating roller, and said retaining means comprise a balancer arm adapted to be driven through friction by said separating means in order to come into engagement with one or the other of trays depending on the direction of rotation of said separating means.

8. An office machine according to claim 5, comprising a print unit provided for printing recording sheets fed from one of said trays and a read unit provided for reading original sheets fed from by the other of said trays.

9. An office machine according to claim 8, in which the sheets coming from said trays are conveyed towards a frontal side of said office machine for being received by an operator, wherein the tray from which said original sheets are fed is arranged before the tray from which said recording sheets are fed, when observing said trays from said frontal side.

10. A device according to claim 1, further comprising a motor adapted to rotate selectively in opposite directions of rotation, and linking means provided for selectively connecting in the rotation said motor with said separating means, whereby said motor commands rotation of said separating means according to said first direction or said second direction of rotation.

11. A device according to claim 10, wherein said device is incorporated in a printer including a moveable carriage, said linking means comprising a lever mechanism which is provided for being actuated by the movement of said carriage.

12. A device according to the claim 10, further comprising feeding means adapted to receive the sheets coming from said first or from said second tray in order to feed them according to an advancing direction, and unidirectional command means adapted to transmit the motion from said motor to said feeding means, wherein said unidirectional command means are capable of commanding said feeding means in such a way that said feeding means operate for feeding the sheets uniquely along said advancing direction, irrespectively of the direction of rotation of said motor.

13. A device according to claim 12, wherein said unidirectional command means are provided for being controlled by said actuating member in synchronism with said selection mechanism, in such a way to activate feeding of the sheets by said feeding means with a predetermined delay after said feeding means are reached by the sheets.

* * * * *